United States Patent [19]

Kuchinsky et al.

[11] 3,952,223

[45] Apr. 20, 1976

[54] MULTIPLE CHARACTER FLAT PANEL DISPLAY DEVICE

[75] Inventors: Saul Kuchinsky, Somerville, N.J.; Roger W. Wolfe, San Diego, Calif.; Thomas C. Maloney, Bernardsville; William M. Hennessey, Somerville, both of N.J.

[73] Assignee: Burroughs Corporation, Detroit, Mich.

[22] Filed: Mar. 3, 1975

[21] Appl. No.: 554,887

Related U.S. Application Data

[60] Division of Ser. No. 391,373, Aug. 24, 1973, which is a continuation of Ser. No. 188,485, Oct. 12, 1971, abandoned, which is a continuation of Ser. No. 870,678, Oct. 27, 1969, abandoned.

[52] U.S. Cl. ..... 313/519; 313/210; 313/217; 313/220

[51] Int. Cl.[2] ..... H01J 61/067; H01J 61/66

[58] Field of Search ..... 313/494, 518, 519, 210, 313/220, 190, 313, 217

[56] References Cited

UNITED STATES PATENTS

| | | | |
|---|---|---|---|
| 2,686,273 | 8/1954 | Hough et al. | 313/190 |
| 2,906,906 | 9/1959 | McCauley et al. | 313/190 X |
| 3,231,776 | 1/1966 | Britnell et al. | 313/517 |
| 3,327,153 | 6/1967 | Bickmire et al. | 313/512 |
| 3,327,154 | 6/1967 | Bowerman | 313/519 |
| 3,418,509 | 12/1968 | Frouws et al. | 313/519 |
| 3,588,571 | 6/1971 | Uemura et al. | 313/519 |

FOREIGN PATENTS OR APPLICATIONS

| | | |
|---|---|---|
| 24,119 | 11/1968 | Japan |

*Primary Examiner*—Palmer C. Demeo
*Attorney, Agent, or Firm*—Kenneth L. Miller; Robert A. Green; William B. Penn

[57] ABSTRACT

A display device adapted to display one or more characters side by side in a row and including an insulating support plate, on the top surface of which are formed a plurality of groups of conductive members, each group being adapted to be energized to display a character. The device includes various configurations of anode electrodes, shielding electrodes, and interconnections of common characters in each group to provide manufacturing economies.

13 Claims, 5 Drawing Figures

Fig. 1
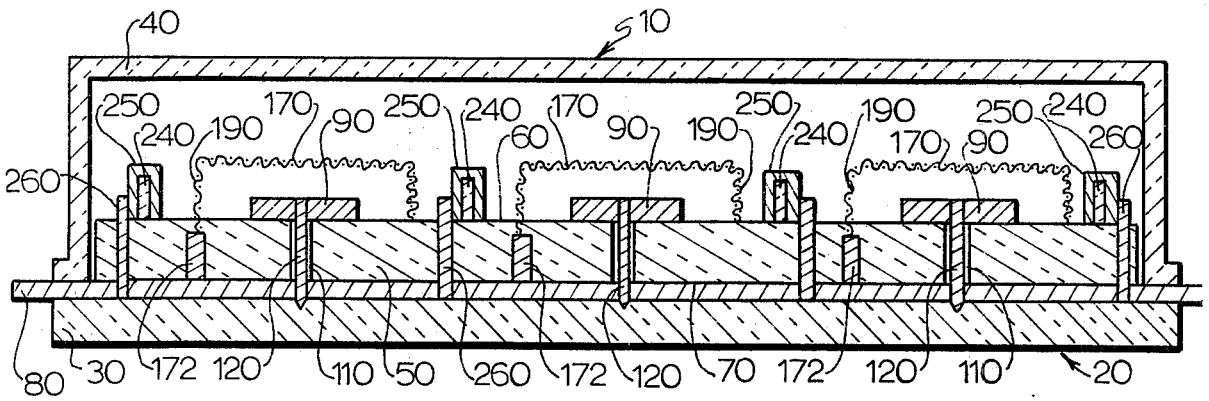
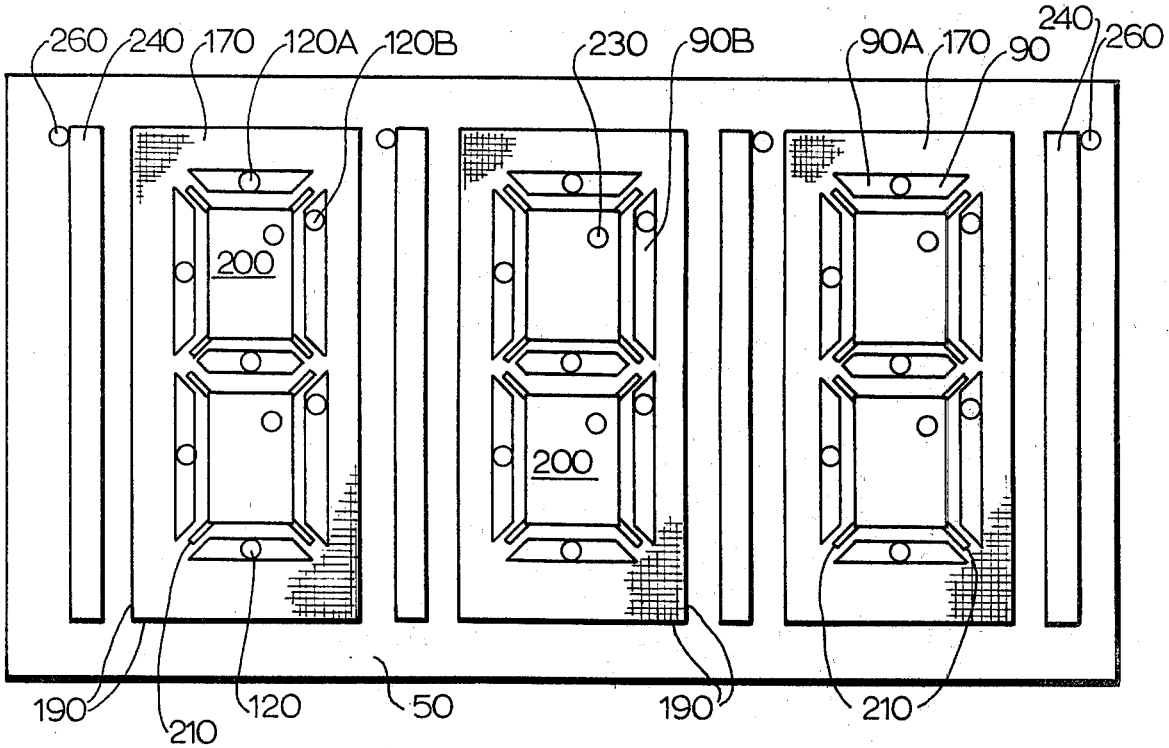
Fig. 2

MULTIPLE CHARACTER FLAT PANEL DISPLAY DEVICE

CROSS-REFERENCE TO RELATED APPLICATIONS

This application is a division of Ser. No. 391,373, filed Aug. 24, 1973 as a continuation of application Ser. No. 188,485, now abandoned, filed Oct. 12, 1971, as a continuation of Ser. No. 870,678, filed Oct. 27, 1969, and now abandoned.

BACKGROUND OF THE INVENTION

For many years now, indicator tubes such as the NIXIE tube of Burroughs Corporation have been widely used in all types of instruments for providing a numerical readout of an electronic circuit logic operation. Such instruments usually include three or more of such tubes, and electronic calculators may include as many as sixteen or more.

According to the present invention, an economic saving can be effected by building the indicator tubes in groups, that is, by providing more than one group of cathode numerals in a single tube envelope, as has been the practice up to now. The present invention provides a novel indicator tube or device including a plurality of groups of cathode electrodes which can be used to display more than one numeral at a time and having novel electrode interconnections and electrode structures.

DESCRIPTION OF THE DRAWING

FIG. 1 is a sectional elevational view of a display device embodying the invention;

FIG. 2 is a plan view of the device of FIG. 1;

DESCRIPTION OF THE PREFERRED EMBODIMENT

Figure 3:
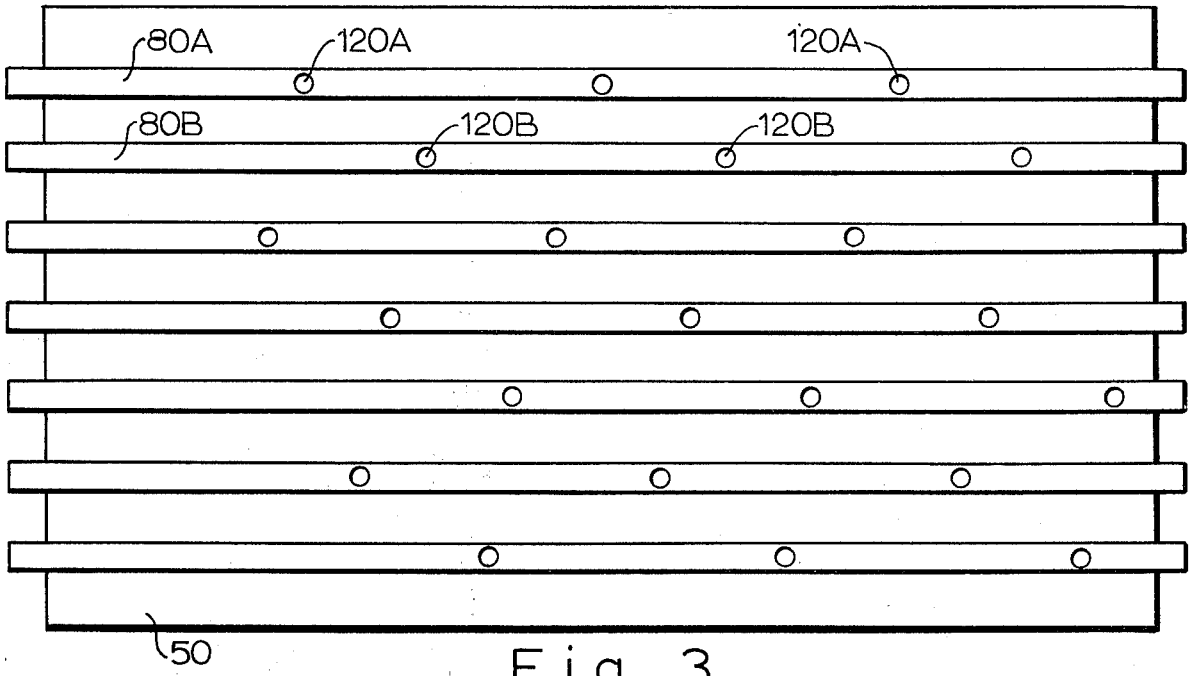
FIG. 3 is a plan view of the bottom surface of a portion of the device of FIG. 1.

Display device 10 embodying the invention includes a glass envelope 20 which is filled with a gas such as argon, neon, or the like which can support cathode glow. The envelope includes a base 30 and viewing window 40 which is secured to the base and encloses the various functional elements of the device which are supported on the base 30.

The functional elements of device 10 include an insulating plate 50, of glass, ceramic, or any suitable material which is supported on base 30 and has a top surface 60 and a bottom surface 70. The plate 50 may be held in place by electrodes to be described, or it may be secured to the base by a glass-to-glass seal, by a suitable cement, by metal pins, or the like (not shown). Metallic leads or runs 80 are interposed between plate 50 and base 30 for a purpose to be described.

A plurality of identical groups of cathode character elements 90 are positioned on the top surface 60 of the insulating plate 50. These cathode character elements 90 may be flat strips of metal, wires, or, preferably, films or coatings of a conductive material such as a mixture of powdered molybdenum and powdered manganese or powdered molybdenum and powdered titanium which is screened or sprayed on the top surface of plate 50. Such a film or coating might also be plated with nickel or otherwise treated.

The cathode elements 90 are formed in groups of seven, three such groups being shown side-by-side (FIG. 2) so that three numerals or other characters can be displayed side-by-side at the same time by energizing selected cathodes in each group. In FIG. 1, the cathodes 90 are shown as linear segments which can be combined in different groups to represent different characters such as numbers or letters. Of course, more than seven or fewer than seven elemements might be provided, as desired.

Electrical contact may be made to each cathode element in different ways. In one arrangement, an aperture 110 is provided in the insulating plate 50 directly beneath a portion of each cathode element, with the apertures associated with corresponding elements in each group being at the same general position on the plate to facilitate making common connections thereto as described below. However, the aperture associated with one cathode is at a different location than the aperture associated with the other cathodes in its group so that a straight line can be drawn interconnecting each corresponding aperture without any of the lines crossing each other. Each aperture 110 carries a conductive member 120 which makes electrical contact with its cathode and extends downwardly to the bottom surface 70 of plate 50. The conductive lining 120 may be a conductive coating or a pin or a wire which makes suitable contact with its cathode element.

A separate conductive lead or run 80 (FIG. 3) is connected to each terminal or hole conductor 120 on the bottom surface of the insulating plate, with each lead 80 being connected to the terminal associated with the same cathode element in each group of elements. Thus, for example, the top conductor 80A interconnects contacts 120A to each of the top horizontal cathodes 90A (FIG. 2), the next lower conductor 80B interconnects contacts 120B associated with the upper right cathodes 90B (FIG. 2), etc. The leads 80 may be flat metal conductors prepared by a photochemical etching process, or they may be individual strips held in place mechanically or by a cement, between the plate 50 and the base 30 of the envelope and extending through glass-to-metal seals in the wall of the envelope to provide portions outside the envelope, to which external circuit contact can be made. If the conductors 80 are individual strips, they may be soldered to the hole conductors 120, or they may have apertures into which the hole conductors, if they are pin-like, are pressed and held by a mechanical tight fit.

The conductors 80 may extend through one or both ends of the envelope, or some may extend through one end, and the others may extend through the opposite end.

The device 10 also includes a separate anode electrode 170 for each group of cathode elements. The anodes may take many different forms, and in one arrangement, each anode is a generally flat, thin rectangular fine mesh screen which covers its group of cathode elements and has four side panels 190 which are bent down along all four sides of the cathode arrays. The anodes may be held in place by means of tabs 172 or the like secured to panels 190 and inserted in holes in plate 50. In addition, one or more such tabs may extend through plate 50, to a conductor 80 on the bottom surface of plate 50 whereby electrical contact may be made separately to each anode.

The anode electrode for each group of elements might comprise, alone or in combination with the screens 170, a conductive film or coating 200 (FIG. 2) of relatively large size formed between the upper four segments and between the lower four cathode segments 90 (FIG. 2) and including radiating arms 210 which might comprise film or wires and which extend into and lie between the adjacent ends of the cathode segments. Electrical contact may be made to this anode structure also through the plate 50, for example, by means of pins 230 which make contact to a suitable conductor arrangement 80 (not shown) on the bottom surface of plate 50.

In order to isolate adjacent groups of cathode and anode electrodes from each other, a rib or wall 240 of insulating material is provided between adjacent groups, and preferably these ribs carry a metal shield coating 250. Electrical contact may be made to this shield coating by means of suitable pins 260 or the like which pass through plate 50 to suitable conductors. In addition, if the insulating sheet is of a ceramic material, the ribs 240 may be formed when the sheet is formed as an integral portion thereof.

Figure 4:
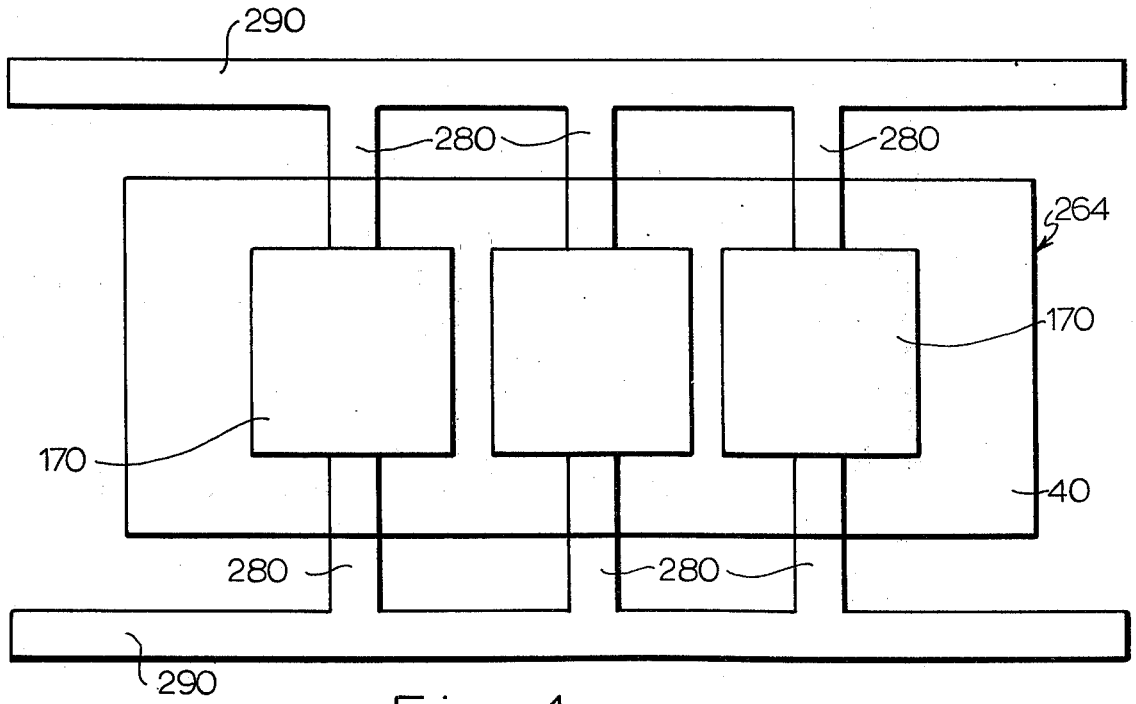
FIG. 4 is a plan view of a modification of a portion of the invention.

In one convenient anode arrangement used in manufacturing the device 10 and referring to FIG. 4, the anode screens 170 are connected together in a unitary assembly 264 by leads 280 projecting from opposite ends of each anode to a common horizontal plate lead 290. This structure can be prepared in a single electrochemical etching operation from a flat piece of metal. During manufacture of the device 10, the anode assembly 264 is set in place, and the anode leads 180 are sealed between the viewing window and the base. Then the leads 280 are cut, for example, where they join the leads 290, to remove the common leads and thus to separate the anode screens from each other.

Figure 5:
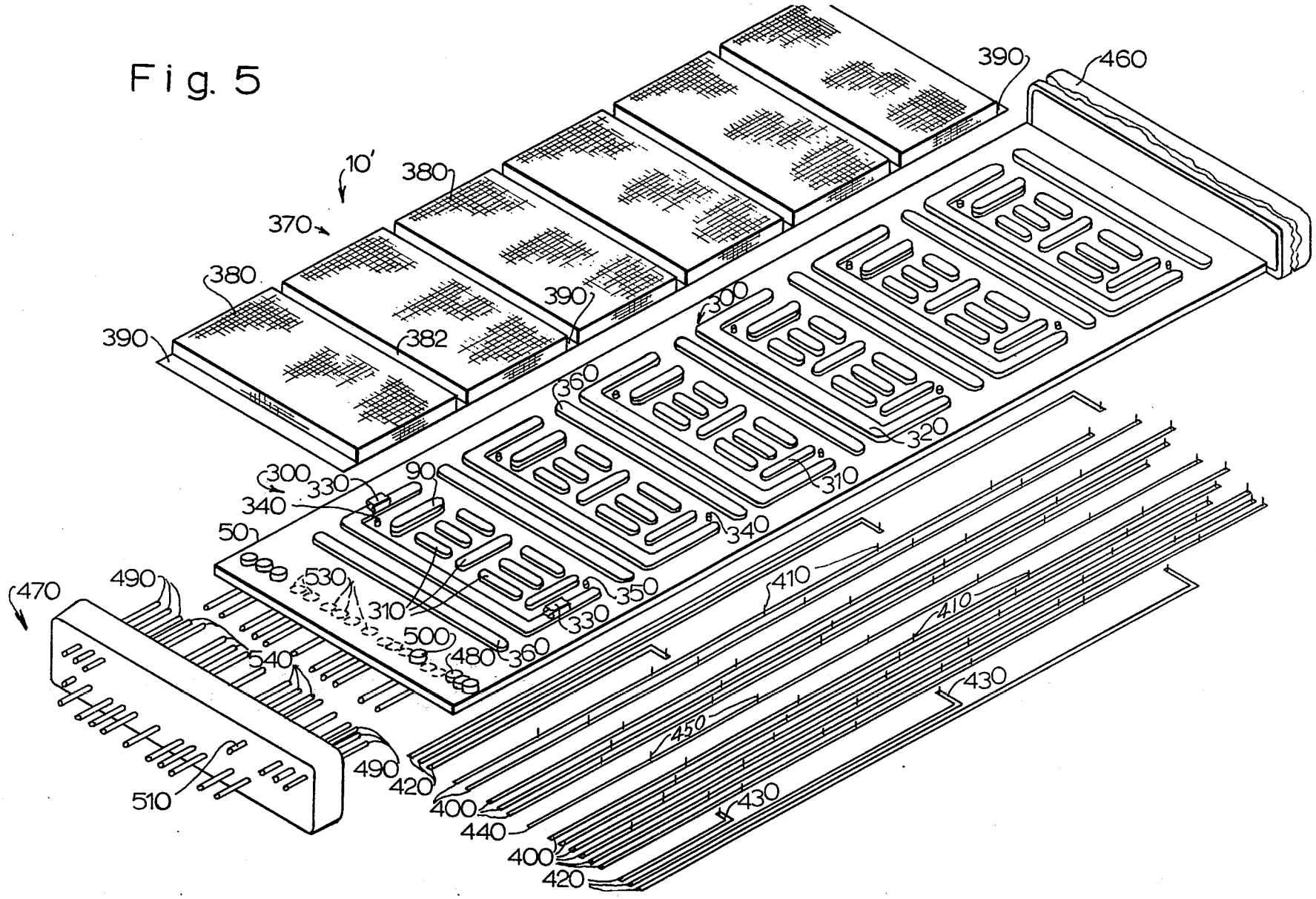
FIG. 5 is an exploded view of another panel embodying the invention.

Another panel 10', shown exploded in FIG. 5, includes all of the elements of the panel 10 with modifications of portions thereof. In panel 10', insulating plate 50 includes insulating elevations or ridges 300 on which the various electrodes of the panel are supported. Nine elevations 310 are shown in each group for supporting cathode electrodes 90 which, for convenience, are shown only on two elevations in the first group of elevations 300. An elevation 320 is provided for supporting the anode electrode 330 which is shown as C-shaped and enclosing the cathode elevations 310 and cathodes 90 on three sides. If space permits, the anode could completely surround the cathodes.

Panel 10' also includes auxiliary elevations 340 for supporting auxiliary cathodes 350 (only one of which is shown) which are shaped to represent decimal points. Of course, they may also be shaped as commas or the like. Two such auxiliary electrodes are provided at diagonally opposed corners so that the panel can be oriented as shown or turned 180°, while retaining an auxiliary electrode or decimal point in its proper operating position.

Panel 10' also includes linear elevations 360, positioned between each group of electrodes, for supporting an electrostatic shield 370. The electrostatic shield is shown as a unitary structure including a large-area screen 380 which overlays each group of electrodes, side panels 382 which lie between groups of electrodes, and a support plate 390 between each of the screens and adapted to be seated on the elevation 360.

Panel 10' includes conductive runs 400 on the bottom surface of plate 50 for making connection to the cathodes 90 by way of pins 410. Runs 420 connect to each one of the anodes 330 by pins 430, and run 440 connects to the shield 370 by pins 450.

Panel 10' (and panel 10) is mounted in a generally flat, elongated envelope 460, and it includes a header 470 which carries pins for making contact to the runs 400, 420, and 440. As part of the connecting arrangement to the header, the plate 50 is provided at one end with a series of pins 480, three near one edge and three near the other, which extend through the plate 50 and are welded or soldered on the bottom surface to anode runs 420. The pins 420 are contacted adjacent to the top surface of plate 50 by pins 490 in header 470. Run 440 is similarly connected to pin 500, and this is contacted by pin 510 in reader 470. The cathode runs 400 are secured to pins 530 adjacent to the bottom surface of plate 50, and these pins are contacted by pins 540 in header 470. It is to be noted that this arrangement provides easy electrical connection to the various panel electrodes by having the pins in the header arrayed in two rows.

It will be clear to those skilled in the art that modifications may be made in the various structures described within the scope of the invention. For example, although one theory would indicate that continuous sputtered metal paths will not form between the anode arms 210 and the adjacent cathodes (FIG. 2), it may be desirable to roughen or groove the surface of plate 50 between these elements to prevent such paths from forming. In addition, the cathode and anode materials and the material of the insulating plate 50 may be any one of many well known materials. The method of preparation of the various parts may also be varied as required.

What is claimed is:

1. A flat display panel for displaying any one of a predetermined number of characters in each of a plurality of side-by-side character positions, comprising a gas-tight envelope formed of front and base plates closely spaced to one another and sealed together along a predetermined perimeter surrounding the character positions, the front and base plates forming outside walls of the envelope, an ionizable gas within said envelope at a pressure capable of sustaining glow discharge, at least the portions of the front plate which are aligned with the character positions being transparent to glow within the envelope to provide a viewing window for the characters to be displayed, an assembly supported on the interior surface of the base plate including a plurality of conductive runs on said interior surface, insulating material on said conductive runs, and a plurality of groups of cathode electrodes arranged side-by-side on said insulating material, with each such group forming one of said character positions, each such conductive run being electrically connected through said insulating material to a cathode electrode in each of said cathode electrode groups, the connection being made in each case through an aperture located directly behind and covered by the cathode electrode, so that selective combinations of said cathode electrodes in each such group can be energized by a predetermined energization of said conductive runs to provide a multi-character display, said conductive runs extending along said interior surface throughout the length of said cathode electrode groups and continuing along said surface beyond said groups to the envelope perimeter, and then extending beyond said perimeter to provide external electrical connections to said cathode electrodes, with at least the majority of said conductive runs passing directly behind all of said cathode electrode groups and none of the conductive runs crossing one another or crossing the connections between another one of said conductive runs and the cathode electrodes, and a plurality of anode electrodes, each positioned in operative relation with one of said cathode electrode groups and having a conductive lead extending through said envelope.

2. A flat display panel as in claim 1, wherein the cathode electrodes in the different cathode electrode groups are disposed in substantially the same pattern, and each cathode electrode is shaped in the form of a segment of a character to be displayed, and wherein each conductive run is electrically connected to the correspondingly positioned cathode electrode in each of said groups.

3. A flat display panel for displaying any one of a predetermined number of characters in each of a plurality of side-by-side character positions, comprising a gas-tight envelope formed of a front plate and a base plate closely spaced to one another and sealed together along a predetermined perimeter surrounding the character positions, the front and rear plates forming outside walls of the envelope, an ionizable gas within said envelope at a pressure capable of sustaining glow discharge, at least the portions of the front plate which are aligned with the character positions being transparent to glow within the envelope to provide a viewing window for the characters to be displayed, and an assembly supported on the interior surface of the base plate including a first and second plurality of conductive runs extending along said interior surface in a predetermined direction, a layer of insulating material on said conductive runs, a plurality of groups of cathode electrodes aligned side-by-side on said insulating layer along said predetermined direction, with each such group forming one of said character positions, and a plurality of anode electrodes in substantially the same plane as said cathode electrodes, at least one such anode electrode being associated with and disposed adjacent each of said cathode electrode groups, each conductive run of said first plurality being electrically connected to at least one of said anode electrodes, each conductive run of said second plurality extending along the length of said cathode electrode groups in said predetermined direction, and being electrically connected through said insulating layer to a cathode electrode in each of said cathode electrode groups, the connection being made in each case through an aperture located directly behind and covered by the cathode electrode, so that selective combinations of said cathode electrodes in each such group can be energized to provide a multi-character display, said first and second pluralities of conductive runs extending along the interior surface of the base plate beyond said cathode electrode groups to said envelope perimeter, and beyond said perimeter to provide external electrical connections to said cathode and anode electrodes, and none of the conductive runs crossing one another or crossing the connections between another one of said conductive runs and the cathode electrodes.

4. A flat display panel as in claim 3, wherein the cathode electrodes in the different cathode electrode groups are disposed in substantially the same pattern, and each cathode electrode is shaped in the form of a segment of a character to be displayed, and wherein each conductive run of the second plurality is electrically connected to the correspondingly positioned cathode electrode in each of said groups.

5. A flat display panel for displaying any one of a predetermined number of characters in each of a plurality of side-by-side character positions along a predetermined line, comprising a gas-tight envelope formed of a front plate and a base plate closely spaced to one another and sealed together along a predetermined perimeter surrounding the character positions, the front and rear plates forming outside walls of the envelope, an ionizable gas within said envelope at a pressure capable of sustaining a glow discharge, at least the portions of the front plate which are aligned with the character positions being transparent to glow within the envelope to provide a viewing window for the characters to be displayed, a plurality of elongated conductive runs extending along the inside surface of said base plate in the direction of the line of character positions, a layer of insulating material over said conductive runs with a group of apertures therethrough for each character position, at least the majority of the apertures of each such group being aligned with the conductive runs, a plurality of groups of cathode electrodes arranged side-by-side along the surface of said insulating layer facing the viewing window to form the side-by-side character positions, with the cathode electrodes of the different groups being disposed in substantially the same pattern and each cathode electrode having the shape of a segment of a character to be displayed, one of said cathode electrodes being aligned with and covering each of said apertures, and electrically connected through the aperture to one of said conductive runs, so as to produce a glow discharge along selective combinations of the cathode electrodes in any one of said cathode electrode groups, and thereby display different characters through said viewing window, by a predetermined energization of said conductive runs, said conductive runs being spaced from one another and none of the conductive runs crossing one another or crossing the connections between another one of said conductive runs and the cathode electrodes, and a plurality of anodes insulated from each other and from said cathode electrodes, one such anode being located adjacent to and operatively associated with each of said cathode electrode groups.

6. A flat display panel as in claim 5 wherein each such anode has a portion which is substantially coplanar with the cathode electrodes of its associated cathode electrode group, and each anode surrounds at least the majority of said cathode electrodes of said group on at least three sides.

7. A flat display panel for displaying any one of a predetermined number of characters in each of a plurality of side-by-side character positions, comprising a gas-tight envelope formed of front and base plates closely spaced to one another and sealed together along a predetermined perimeter surrounding the character positions, the front and base plates forming outside walls of the envelope, an ionizable gas within said envelope at a pressure capable of sustaining glow discharge, at least the portions of the front plate which are aligned with the character positions being transparent to glow within the envelope to provide a viewing window for the characters to be displayed, an assembly supported on the interior surface of the base plate including a plurality of conductive runs extending along said interior surface in the direction of the side-by-side character positions, a plurality of groups of cathode electrodes positioned side-by-side in said direction, each such group forming one of said character positions and each cathode electrode in the group being in contact with at least one of said conductive runs, and an insulating layer covering said conductive runs and said interior surface in the area of the character positions, said insulating layer having a plurality of groups of apertures therethrough, each such aperture aligned with one of said cathode electrodes, each such conductive run being electrically connected to a cathode electrode in each of said cathode electrode groups, so that selective combinations of cathode electrodes in each such group can be energized by a selective energization of said conductive runs, said conductive runs extending along said interior surface throughout the length of said cathode electrode groups and continuing along said surface to the envelope perimeter, and then beyond the perimeter to provide external electrical connections to said cathode electrodes, with none of the conductive runs crossing one another or crossing the connection between another one of said conductive runs and the cathode electrodes, and a plurality of anode electrodes each positioned in operative relation with one of said cathode electrode groups and having a conductive lead extending through said envelope.

8. A flat display panel for displaying any one of a predetermined number of characters in each of a plurality of side-by-side character positions, comprising a gas-tight envelope containing an ionizable gas at a pressure capable of sustaining glow discharge, said envelope being formed of a front plate with at least the portions thereof which are aligned with the character positions being transparent to glow within the envelope, and a base plate having a surface thereof facing the front plate and closely spaced thereto, an assembly supported on said base plate surface including a plurality of conductive runs extending along said surface in the direction of the side-by-side character positions, a plurality of groups of cathode electrodes positioned side-by-side in said direction, each such group forming one of said character positions, and an insulating layer covering said conductive runs and said surface in the area of the character positions, said insulating layer having an aperture therethrough aligned with each of said cathode electrodes, the cathode electrodes in each of said cathode electrode groups being disposed in substantially the same pattern, such pattern having a predetermined height to display characters of that height, and each cathode electrode being shaped in the form of a segment of a character to be displayed, each such conductive run being electrically connected to a correspondingly positioned cathode electrode in each of said cathode electrode groups, so that selective combinations of said cathode electrodes in each such group can be energized by a predetermined energization of said conductive runs to provide a multi-character display, at least the majority of said conductive runs extending along said base plate surface within the height of said cathode electrode patterns throughout the length of said cathode electrode groups and continuing along said surface beyond said groups and passing through the envelope on said surface to provide external electrical connections for said cathode electrodes, and a plurality of anode electrodes, each positioned in operative relation with one of said cathode electrode groups and having a conductive lead extending through said envelope.

9. A flat display panel for displaying any one of a predetermined number of characters in each of a plurality of side-by-side character positions, comprising a gas-tight envelope formed of front and base plates closely spaced to one another and sealed together along a predetermined perimeter surrounding the character positions, the front and base plates forming outside walls of the envelope, an ionizable gas within said envelope at a pressure capable of sustaining glow discharge, at least the portions of the front plate which are aligned with the character positions being transparent to glow within the envelope to provide a viewing window for the characters to be displayed, an assembly supported on the inside surface of the base plate including a plurality of conductive runs extending along said inside surface in the direction of the side-by-side character positions, a plurality of groups of cathode electrodes positioned side-by-side in said direction, each such cathode electrode being in contact with at least one of said conductive runs, and an insulating layer covering said conductive runs and said inside surface in the area of the character positions, said insulating layer having a plurality of apertures therethrough, each aligned with one of said cathode electrodes, each such cathode electrode being shaped as a segment of a character to be displayed, and each cathode electrode group forming one of said character positions, with the cathode electrodes of the different groups being disposed in a pattern having a predetermined height, each such conductive run being electrically connected to a correspondingly positioned cathode electrode in each of said cathode electrode groups, so that selective combinations of cathode electrodes in each such group can be energized by a predetermined energization of said conductive runs, at least the major portion of said conductive runs extending along said inside surface within the height of said cathode electrode patterns throughout the length of said cathode electrode groups, and none of the conductive runs crossing one another or crossing the connections between another one of said conductive runs and the cathode electrodes, and a plurality of anode electrodes, each positioned in operative relation with one of said cathode electrode groups and having a conductive lead extending through said envelope.

10. A flat display panel as in claim 9, wherein at least certain of the segment-shaped cathode electrodes of each cathode electrode group are disposed in a figure "8" array, and wherein thin conductive members extend between the adjacent ends of said segment-shaped cathode electrodes.

11. A gas discharge display panel for displaying characters in a plurality of side-by-side character positions along a predetermined line, in each such position any one of a predetermined number of characters can be displayed, comprising an envelope formed of a front plate with a viewing window and a rear plate, said plates being sealed together along a predetermined perimeter surrounding the line of character positions to establish a gas-tight enclosure about said character positions, an ionizable gas within said enclosure at a pressure capable of sustaining a cathode glow discharge, a plurality of elongated straight conductive runs extending along the inside surface of the rear plate in the direction of the line of character positions, a layer of insulating material over said conductive runs with a group of apertures therethrough for each character position, the respective apertures in each such group being substantially aligned with the respective conductive runs, a plurality of groups of cathode segments arranged side-by-side along the surface of said insulating layer to form the side-by-side character positions, each cathode segment being aligned with one of said apertures, the cathode segments in each group being disposed in substantially the same pattern as those in the other groups, with each such pattern having substantially the same height to fix the height of the characters to be displayed, all of said conductive runs passing directly behind all of said cathode segment groups and being located substantially within the height of the cathode segment patterns, each such conductive run passing under at least one cathode segment in each of the cathode segment groups, but being electrically connected through only one aperture of each group to only one cathode segment in each cathode segment group to render the cathode segments in each group selectively energizable to display different characters through said viewing window by a selective energization of said conductive runs, a plurality of anodes insulated from each other and from said cathode segments, each such anode being located adjacent and operatively associated with one of said cathode segment groups, and means for energizing the anodes sequentially and for selectively energizing different combinations of the conductive runs sequentially, in synchronism with the sequential energization of the anodes, to form a side-by-side character display over all of said character positions, said energizing means including a plurality of conductive terminals connected to said conductive runs and a plurality of anode conductors, one connected to each of said anodes, with each such anode conductor extending away from its associated anode and exiting through the gas-tight enclosure along a path transverse to the direction of the conductive runs.

12. A gas discharge display panel as in claim 11 wherein the anodes are all located between their associated cathode segments and the front plate.

13. A gas discharge display panel for displaying characters in a plurality of side-by-side character positions along a predetermined line, in each such position any one of a predetermined number of characters can be displayed, comprising a gas-tight envelope having a front plate with a viewing window for viewing the characters to be displayed, an ionizable gas within said envelope at a pressure capable of sustaining a cathode glow discharge, a flat layer of insulating material having a plurality of side-by-side groups of apertures therethrough, one for each character position, said insulating layer being substantially parallel to the transparent front plate and having at least its front surface in contact with the ionizable gas, a plurality of substantially parallel elongated conductive runs extending along the rear surface of said insulating layer in the direction of the line of character positions, each such conductive run being substantially aligned with one of said apertures in each aperture group, a plurality of groups of cathode segments arranged side-by-side along the front surface of said insulating layer to form the side-by-side character positions, each cathode segment being aligned with one of said apertures, the cathode segments in each group being disposed in substantially the same pattern as those in the other groups, with each such pattern having substantially the same height to fix the height of the characters to be displayed, all of said conductive runs passing directly behind all of said cathode segment groups and being located substantially within the height of the cathode segment patterns, and continuing on said rear surface beyond said cathode segment groups and through said envelope on said surface to provide external electrical connections, each such conductive run passing under at least one cathode segment in each of the cathode segment groups, but being electrically connected through only one aperture of each aperture group to only one cathode segment in each cathode segment group to render the cathode segments in each group selectively energizable to display different characters through said front plate by a selective energization of said conductive runs, a plurality of anodes insulated from each other and from said cathode segments, each such anode being located adjacent and operatively associated with one of said cathode segment groups, and means for energizing the anodes sequentially and for selectively energizing different combinations of the conductive runs sequentially, in synchronism with the sequential energization of the anodes, to form a side-by-side character display over all of said character positions, said energizing means including a plurality of conductive terminals connected to said conductive runs and a plurality of anode conductors, one connected to each of said anodes, with each such anode conductor extending away from its associated anode and exiting through the gas-tight enclosure along a path transverse to the direction of the conductive runs.

* * * * *

Disclaimer 3,952,223.—*Saul Kuchinsky*, Somerville, N.J., *Roger W. Wolfe*, San Diego, Calif., and *Thomas C. Maloney*, Bernardsville, and *William M. Hennessey*, Somerville, N.J. MULTIPLE CHARACTER FLAT PANEL DISPLAY DEVICE. Patent dated Apr. 20, 1976. Disclaimer filed June 14, 1976, by the assignee, *Burroughs Corporation*.

The term of this patent subsequent to Feb. 25, 1992, has been disclaimed.

[*Official Gazette August 17, 1976.*]